US008836625B2

(12) United States Patent
Cheon et al.

(10) Patent No.: US 8,836,625 B2
(45) Date of Patent: Sep. 16, 2014

(54) DISPLAY DEVICE AND APPARATUS AND METHOD FOR DRIVING THE SAME

(75) Inventors: Man-Bok Cheon, Yongin-si (KR); Byung-Kil Jeon, Anyang-si (KR)

(73) Assignee: Samsung Display Co., Ltd. (KR)

( * ) Notice: Subject to any disclaimer, the term of this patent is extended or adjusted under 35 U.S.C. 154(b) by 1210 days.

(21) Appl. No.: 11/219,776

(22) Filed: Sep. 7, 2005

(65) Prior Publication Data

US 2006/0050038 A1 Mar. 9, 2006

(30) Foreign Application Priority Data

Sep. 8, 2004 (KR) ..... 10-2004-71852

(51) Int. Cl.
*G09G 3/36* (2006.01)

(52) U.S. Cl.
CPC ..... *G09G 3/3648* (2013.01); *G09G 2340/16* (2013.01); *G09G 2320/041* (2013.01); *G09G 2320/0261* (2013.01); *G09G 2320/0252* (2013.01)
USPC ..... 345/89; 345/87

(58) Field of Classification Search
USPC ..... 345/88–90, 92, 94–96, 98–101, 106, 345/204–206, 208–210, 214, 215, 690; 349/20, 33, 34, 36–39, 41, 42, 54, 72, 349/161, 199
See application file for complete search history.

(56) References Cited

U.S. PATENT DOCUMENTS 4,387,963 A * 6/1983 Brennan ..... 349/199
5,926,162 A * 7/1999 Wood et al. ..... 345/101
7,038,647 B2 * 5/2006 Shigeta et al. ..... 345/89
7,248,241 B2 * 7/2007 Chen et al. ..... 345/89
7,248,242 B2 * 7/2007 Chen et al. ..... 345/89
7,532,186 B2 * 5/2009 Tsai et al. ..... 345/89
2002/0158825 A1 * 10/2002 Endo et al. ..... 345/87
2003/0107546 A1 * 6/2003 Ham ..... 345/101
2003/0137521 A1 * 7/2003 Zehner et al. ..... 345/589
2003/0156092 A1 * 8/2003 Suzuki et al. ..... 345/98
2003/0179175 A1 * 9/2003 Shigeta et al. ..... 345/101
2003/0231158 A1 * 12/2003 Someya et al. ..... 345/101

(Continued)

FOREIGN PATENT DOCUMENTS

JP 2003-208142 A 7/2003
JP 2004-004629 A 1/2004

(Continued)

*Primary Examiner* — William Boddie
*Assistant Examiner* — Mansour M Said
(74) *Attorney, Agent, or Firm* — Innovation Counsel LLP

(57) ABSTRACT

A display device including a liquid crystal display unit and a controller displays an image using a liquid crystal. The controller extracts a compensation data from a gray compensation look-up table (LUT) corresponding to a temperature interval including a peripheral temperature of the display device to output the compensation data to the liquid crystal display unit as a compensated gray data. When the gray compensation LUT does not exist, the controller extracts the compensation data from the gray compensation LUT corresponding to the temperature interval approximating the peripheral temperature to generate the compensated gray data. The gray compensation LUT as a default and a calculated gray compensation LUT may be used to provide the compensated gray data optimized for the response speed of the liquid crystal according to variance in temperature, while reducing a memory capacity of a ROM and a RAM inside the timing controller and an external EEPROM.

9 Claims, 11 Drawing Sheets

(56) References Cited

U.S. PATENT DOCUMENTS

| | | | | |
|---|---|---|---|---|
| 2004/0201564 | A1* | 10/2004 | Sugino et al. | 345/101 |
| 2004/0207588 | A1* | 10/2004 | Shiomi | 345/87 |
| 2004/0246224 | A1* | 12/2004 | Tsai et al. | 345/100 |
| 2004/0263450 | A1* | 12/2004 | Lee et al. | 345/87 |
| 2005/0068343 | A1* | 3/2005 | Pan et al. | 345/690 |
| 2006/0103682 | A1* | 5/2006 | Kunimori et al. | 345/690 |

FOREIGN PATENT DOCUMENTS

| | | | | |
|---|---|---|---|---|
| JP | 2004-109796 | A | 4/2004 | |
| TW | 548616 | B | 8/2003 | |
| TW | 200303001 | A | 8/2003 | |
| TW | 200405990 | A | 4/2004 | |
| WO | WO 03041043 | A1 * | 5/2003 | G09G 3/36 |
| WO | WO 2004034135 | A1 * | 4/2004 | G02F 1/133 |

* cited by examiner

FIG. 5A

T=20°C

Gn-1

| Gn | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 16 | 32 | 16 | 9 | 7 | 5 | 3 | 3 | 3 | 1 | 0 | 0 | 0 | 0 | 0 | 0 | 0 | 0 |
| 32 | 86 | 55 | 32 | 22 | 18 | 14 | 12 | 10 | 8 | 7 | 5 | 4 | 2 | 2 | 2 | 1 | 0 |
| 48 | 124 | 93 | 64 | 40 | 36 | 28 | 23 | 20 | 16 | 14 | 13 | 11 | 9 | 8 | 7 | 6 | 3 |
| 64 | 146 | 116 | 86 | 73 | 54 | 52 | 42 | 34 | 29 | 25 | 22 | 17 | 15 | 14 | 12 | 10 | 7 |
| 80 | 163 | 137 | 111 | 98 | 89 | 80 | 72 | 66 | 57 | 50 | 42 | 34 | 28 | 25 | 22 | 18 | 15 |
| 96 | 176 | 151 | 130 | 120 | 112 | 104 | 96 | 89 | 83 | 77 | 70 | 63 | 55 | 50 | 43 | 33 | 27 |
| 112 | 186 | 163 | 144 | 137 | 131 | 125 | 118 | 112 | 106 | 99 | 93 | 87 | 80 | 75 | 69 | 63 | 48 |
| 128 | 195 | 174 | 159 | 152 | 147 | 142 | 137 | 133 | 128 | 122 | 116 | 110 | 104 | 98 | 91 | 88 | 77 |
| 144 | 207 | 185 | 173 | 168 | 164 | 160 | 156 | 152 | 149 | 144 | 140 | 135 | 131 | 125 | 120 | 113 | 103 |
| 160 | 217 | 198 | 188 | 184 | 180 | 177 | 174 | 170 | 168 | 164 | 160 | 156 | 152 | 148 | 144 | 139 | 133 |
| 176 | 227 | 210 | 203 | 200 | 197 | 193 | 190 | 188 | 186 | 182 | 180 | 176 | 173 | 170 | 166 | 161 | 154 |
| 192 | 237 | 224 | 219 | 217 | 214 | 212 | 209 | 207 | 204 | 202 | 199 | 196 | 192 | 190 | 187 | 183 | 178 |
| 208 | 245 | 235 | 232 | 229 | 226 | 226 | 224 | 222 | 220 | 218 | 216 | 213 | 211 | 208 | 205 | 202 | 198 |
| 224 | 252 | 245 | 243 | 242 | 241 | 240 | 239 | 237 | 236 | 234 | 232 | 231 | 228 | 227 | 224 | 222 | 219 |
| 240 | 255 | 253 | 252 | 251 | 251 | 250 | 249 | 249 | 248 | 247 | 246 | 245 | 244 | 243 | 242 | 240 | 238 |
| 256 | 256 | 256 | 256 | 256 | 256 | 256 | 256 | 256 | 256 | 256 | 256 | 256 | 256 | 256 | 256 | 256 | 256 |

FIG. 5B

Gn-1

| Gn | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | 0 | 0 |
| 16 | 27 | 16 | 9 | 9 | 7 | 6 | 4 | 4 | 2 | 2 | 1 | 1 | 1 | 1 | 0 | 0 | 0 |
| 32 | 82 | 55 | 32 | 26 | 22 | 19 | 17 | 15 | 13 | 12 | 11 | 10 | 9 | 9 | 6 | 6 | 5 |
| 48 | 113 | 83 | 59 | 48 | 41 | 34 | 32 | 32 | 23 | 22 | 19 | 16 | 16 | 15 | 13 | 12 | 9 |
| 64 | 131 | 101 | 78 | 70 | 64 | 57 | 57 | 57 | 39 | 34 | 30 | 26 | 24 | 23 | 20 | 18 | 15 |
| 80 | 148 | 121 | 99 | 91 | 86 | 80 | 75 | 71 | 67 | 61 | 54 | 51 | 44 | 41 | 35 | 29 | 25 |
| 96 | 160 | 136 | 118 | 112 | 106 | 101 | 96 | 92 | 87 | 83 | 78 | 73 | 69 | 65 | 60 | 51 | 43 |
| 112 | 170 | 148 | 135 | 130 | 126 | 121 | 116 | 112 | 108 | 103 | 98 | 94 | 90 | 86 | 81 | 77 | 68 |
| 128 | 180 | 160 | 150 | 146 | 143 | 139 | 135 | 131 | 128 | 123 | 119 | 115 | 111 | 107 | 101 | 96 | 89 |
| 144 | 191 | 174 | 167 | 163 | 160 | 157 | 153 | 150 | 149 | 144 | 141 | 137 | 134 | 132 | 127 | 123 | 116 |
| 160 | 206 | 187 | 181 | 179 | 177 | 174 | 171 | 168 | 166 | 163 | 160 | 157 | 154 | 151 | 149 | 145 | 140 |
| 176 | 218 | 204 | 198 | 195 | 193 | 190 | 188 | 185 | 184 | 181 | 179 | 176 | 174 | 171 | 168 | 165 | 161 |
| 192 | 231 | 219 | 214 | 212 | 211 | 209 | 207 | 205 | 203 | 200 | 197 | 195 | 192 | 190 | 188 | 186 | 182 |
| 208 | 241 | 232 | 228 | 226 | 225 | 223 | 221 | 219 | 218 | 216 | 214 | 212 | 210 | 208 | 206 | 204 | 199 |
| 224 | 250 | 243 | 241 | 240 | 239 | 238 | 237 | 236 | 234 | 233 | 231 | 229 | 228 | 226 | 224 | 222 | 219 |
| 240 | 255 | 252 | 250 | 250 | 249 | 249 | 248 | 247 | 247 | 246 | 245 | 244 | 243 | 242 | 241 | 240 | 238 |
| 256 | 256 | 256 | 256 | 256 | 256 | 256 | 256 | 256 | 256 | 256 | 256 | 256 | 256 | 256 | 256 | 256 | 256 |

FIG. 5C

T=20° C-30° C

| Gn \ Gn-1 | 0 | 16 | 32 | 48 | 64 | 80 | 96 | 112 | 128 | 144 | 160 | 176 | 192 | 208 | 224 | 240 | 255 |
|---|---|---|---|---|---|---|---|---|---|---|---|---|---|---|---|---|---|
| 0 | | | | | | | | | | | | | | | | | |
| 16 | -0.5 | 0 | 0 | 0.2 | 0.2 | 0.3 | 0.1 | 0.1 | 0.1 | 0.2 | 0.1 | 0.1 | 0.1 | 0.1 | 0 | 0 | 0 |
| 32 | -0.4 | 0 | 0 | 0.4 | 0.4 | 0.5 | 0.5 | 0.5 | 0.5 | 0.5 | 0.6 | 0.6 | 0.7 | 0.7 | 0.4 | 0.5 | 0.5 |
| 48 | -1.1 | -1 | -0.5 | 0 | 0.5 | 0.6 | 0.9 | 1.2 | 0.7 | 0.8 | 0.6 | 0.5 | 0.7 | 0.7 | 0.6 | 0.6 | 0.6 |
| 64 | -1.5 | -1.5 | -0.8 | -0.3 | 0 | 0.5 | 1.5 | 2.3 | 1 | 0.9 | 0.8 | 0.9 | 0.9 | 0.9 | 0.8 | 0.8 | 0.8 |
| 80 | -1.5 | -1.6 | -1.2 | -0.7 | -0.3 | 0 | 0.3 | 0.5 | 1 | 1.1 | 1.2 | 1.7 | 1.6 | 1.6 | 1.3 | 1.1 | 1 |
| 96 | -1.6 | -1.5 | -1.2 | -0.8 | -0.6 | -0.3 | 0 | 0.3 | 0.4 | 0.6 | 0.8 | 1 | 1.4 | 1.5 | 1.7 | 1.8 | 1.6 |
| 112 | -1.6 | -1.5 | -0.9 | -0.7 | -0.5 | -0.4 | -0.2 | 0 | 0.2 | 0.4 | 0.5 | 0.7 | 1 | 1.1 | 1.2 | 1.4 | 2 |
| 128 | -1.5 | -1.4 | -0.9 | -0.6 | -0.4 | -0.3 | -0.2 | -0.2 | 0 | 0.1 | 0.3 | 0.5 | 0.7 | 0.9 | 1 | 0.8 | 1.2 |
| 144 | -1.6 | -1.1 | -0.6 | -0.5 | -0.4 | -0.3 | -0.3 | -0.2 | 0 | 0 | 0.1 | 0.2 | 0.3 | 0.7 | 0.7 | 1 | 1.3 |
| 160 | -1.1 | -1.1 | -0.7 | -0.5 | -0.3 | -0.3 | -0.3 | -0.2 | -0.2 | -0.1 | 0 | 0.1 | 0.2 | 0.3 | 0.5 | 0.6 | 0.7 |
| 176 | -0.9 | -0.6 | -0.5 | -0.5 | -0.4 | -0.3 | -0.2 | -0.3 | -0.2 | -0.1 | -0.1 | 0 | 0.1 | 0.1 | 0.2 | 0.4 | 0.7 |
| 192 | -0.6 | -0.5 | -0.5 | -0.5 | -0.3 | -0.3 | -0.2 | -0.2 | -0.1 | -0.2 | -0.2 | -0.1 | 0 | 0 | 0.1 | 0.3 | 0.4 |
| 208 | -0.4 | -0.3 | -0.4 | -0.3 | -0.1 | -0.3 | -0.3 | -0.3 | -0.2 | -0.2 | -0.2 | -0.1 | -0.1 | 0 | 0.1 | 0.2 | 0.1 |
| 224 | -0.2 | -0.2 | -0.2 | -0.2 | -0.2 | -0.2 | -0.2 | -0.1 | -0.2 | -0.1 | -0.1 | -0.2 | 0 | -0.1 | 0 | 0 | 0 |
| 240 | 0 | -0.1 | -0.2 | -0.1 | -0.2 | -0.1 | -0.1 | -0.2 | -0.1 | -0.1 | -0.1 | -0.1 | -0.1 | -0.1 | -0.1 | 0 | 0 |
| 256 | | | | | | | | | | | | | | | | | |

DISPLAY DEVICE AND APPARATUS AND METHOD FOR DRIVING THE SAME

CROSS REFERENCE TO RELATED APPLICATION

This application claims priority to and the benefit of Korean Patent Application No. 2004-0071852, filed on Sep. 8, 2004, which is hereby incorporated by reference for all purposes as if fully set forth herein.

BACKGROUND OF THE INVENTION

1. Field of the Invention

The present invention relates to a display device and an apparatus and a method for driving the display device, and more particularly to a display device capable of improving a response speed of a liquid crystal and an apparatus and a method for driving the same.

2. Description of the Related Art

Generally, a liquid crystal display (LCD) device poorly displays moving pictures because the response speed of the liquid crystal is slower than a time period corresponding to one frame (referred to as a one frame period), causing a motion blur. The response speed of liquid crystal must be improved to improve the display quality of moving pictures.

To improve a response speed of a liquid crystal of the LCD device, a controller of the display device may operate in an overdrive mode to provide drive current that is either over-compensated or under-compensated (higher or lower) to decrease the time needed to reach a desired brightness. To perform the overdrive mode, a dynamic capacitance compensation (referred to as "DCC") is generally used to perform the overdrive mode.

When using the DCC, an overdrive value of a gray data corresponding to a preceding frame may be determined by comparing the gray data corresponding to the preceding frame and a gray data corresponding to a current gray data.

When using an overdrive circuit, a look-up table (LUT) that stores measured overdrive values is typically used since the overdrive value determined according to the comparison between the current and previous gray data is not linearly changed according to a gray level due to the property of the liquid crystal. A compensation value (or overdrive value) stored in the LUT is generally measured when the vertical frequency is about 60 Hz and the temperature is a normal temperature.

Variation in operational temperature and/or vertical frequency may affect the overdrive value. Since switching speed and dynamic capacitance change as a function of temperature, a set of compensation values measured at a certain temperature will yield different results at other temperatures.

The compensation value is inversely proportional to the temperature and directly proportional to the vertical frequency. When the temperature increases, the desired brightness may be achieved with a smaller compensation value and when the vertical frequency increases, one frame period is shortened so that the compensation value needs to be increased to achieve the desired brightness.

In order to maintain the response speed of the liquid crystal regardless of the variance in the temperature, a temperature inside of the timing controller may be detected by a temperature sensor (exterior or interior to a display panel) so that a LUT may be used that has the optimized compensation value for the sensed temperature.

However, the chip size increases when the LUTs for respective temperatures are all applied to a memory of the timing controller. Further, heat is generated and a capacity of an external EEPROM is increased.

SUMMARY OF THE INVENTION

Accordingly, the present invention is provided to substantially obviate one or more problems due to limitations and disadvantages of the related art.

The present invention provides a display device capable of improving a response speed of a liquid crystal considering an ambient temperature while reducing the memory capacity. The present invention further provides a method of driving the above display device. The present invention still further provides an apparatus for driving the above display device.

Additional features of the invention will be set forth in the description which follows, and in part will be apparent from the description, or may be learned by practice of the invention.

The present invention discloses a display device, including a liquid crystal display unit; and a controller that extracts a compensation data from a gray compensation look-up table (LUT) corresponding to a temperature interval that includes a peripheral temperature of the display device and outputs the compensation data to the liquid crystal display unit as a compensated gray data, wherein when the gray compensation LUT corresponding to the temperature interval including the peripheral temperature does not exist, the controller extracts the compensation data from a gray compensation LUT corresponding to a temperature interval approximating the peripheral temperature of the display device to generate the compensated gray data based on the compensation data and a compensation proportion parameter to provide the compensated gray data to the liquid crystal display unit.

The present invention also discloses a display device, including a liquid crystal panel; a data driver providing a data signal to the liquid crystal panel; a memory storing a compensation data corresponding to a peripheral temperature; and a timing controller reading the compensation data from the memory based on a gray data of a current frame and a gray data of a preceding frame, wherein the timing controller provides the data driver with a compensated gray data, the compensated gray data is the compensation data extracted from a gray compensation look-up table (LUT) corresponding to a temperature interval including the peripheral temperature, and wherein when the gray compensation LUT corresponding to the temperature interval including the peripheral temperature does not exist, the timing controller extracts the compensation data from the gray compensation LUT corresponding to the temperature interval approximating the peripheral temperature to generate the compensated gray data based on the compensation data and a compensation proportion parameter to provide the compensated gray data to the liquid crystal panel.

The present invention also discloses a display device having a liquid crystal panel for displaying an image, including a data driver providing a data signal to the liquid crystal panel; a memory storing a compensation data corresponding to peripheral temperature; and a timing controller reading out the compensation data from the memory based on a gray data of a current frame and a gray data of a preceding frame, wherein the timing controller provides the data driver with the compensation data extracted from a gray compensation look-up table (LUT) corresponding to a temperature interval including the peripheral temperature as a compensated gray data, and wherein when the gray compensation LUT corresponding to the temperature interval including the peripheral temperature does not exist, the timing controller extracts the compensation data from the gray compensation LUT corresponding to the temperature interval approximating the peripheral temperature to generate the compensated gray data based on the compensation data and a compensation proportion parameter to provide the compensated gray data to the liquid crystal panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

FIG. 5A shows a look-up table (LUT) used for compensating a gray when a peripheral temperature is about 20° C.

FIG. 5B is an LUT for compensating a gray when a peripheral temperature is about 30° C.

FIG. 5C is an LUT having a compensation proportion parameter $\alpha$ for temperature compensation corresponding to a neighboring temperature interval.

DESCRIPTION OF THE ILLUSTRATED EMBODIMENTS

Figure 1:
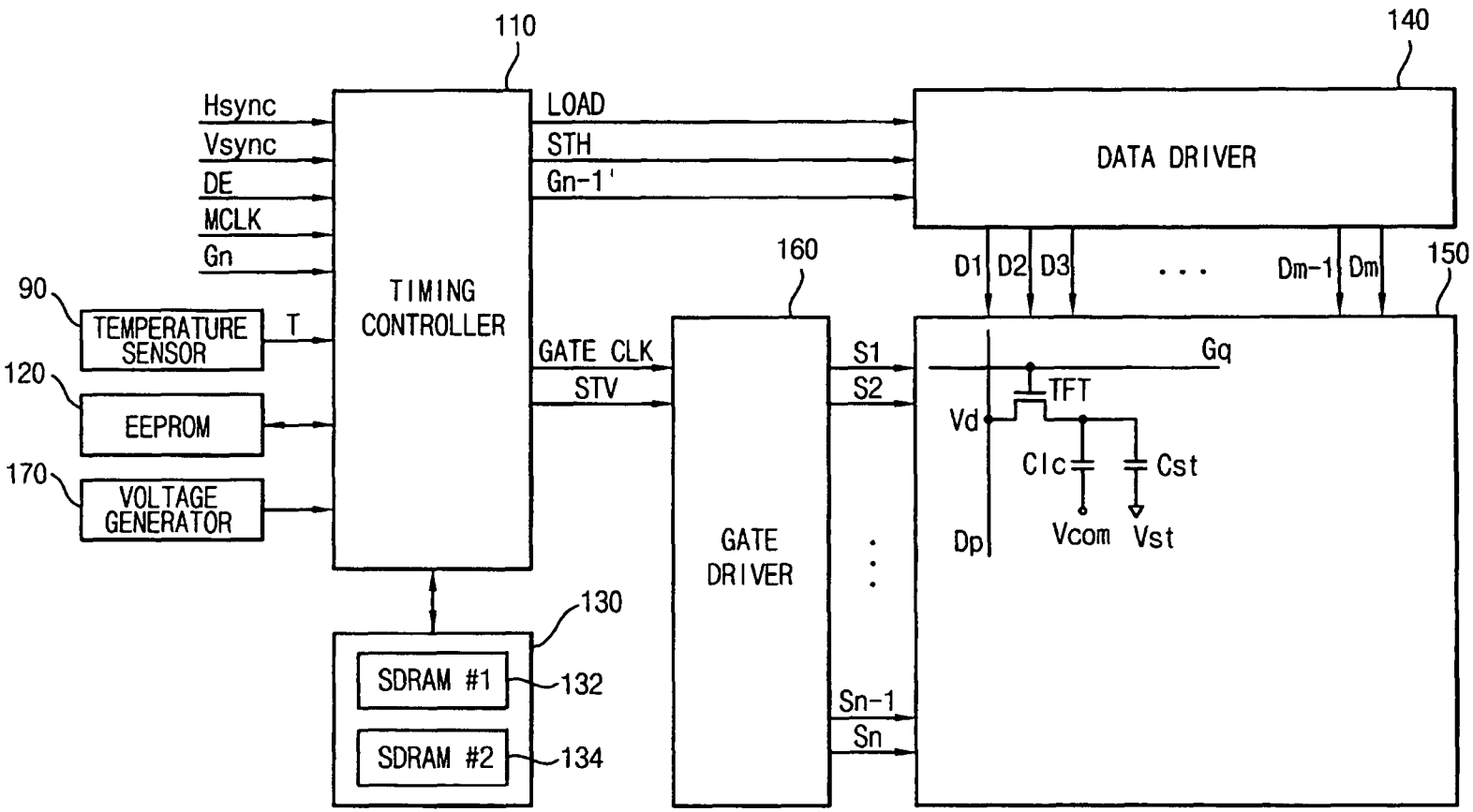
FIG. 1 is a block diagram illustrating a liquid crystal display device according to an embodiment of the invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity.

It is understood that when an element or layer is referred to as being "on" or "connected to" or "connected with" another element or layer, it can be directly on or directly connected to or with the other element or layer or intervening elements or layers may be present.

Hereinafter, the present invention will be explained in detail with reference to the accompanying drawings.

FIG. 1 is a block diagram illustrating a liquid crystal display device according to an embodiment of the invention.

Referring to FIG. 1, the liquid crystal display device includes a temperature sensor 90, a timing controller 110, a first memory (EEPROM) 120, a second memory (SDRAM), a data driver 140, a liquid crystal panel 150, a gate driver 160, and a voltage generator 170. Although the first memory 120 and the second memory 130 are shown as being separated from the timing controller 110 in FIG. 1, the first and second memories 120, 130 may not be physically separated and instead may only be functionally separated from the timing controller 110.

The timing controller 110 outputs a compensated gray data Gn-1' of a preceding frame to increase the response speed of the liquid crystal according to the temperature to the data driver based on a source gray data Gn, synchronization signals HSYNC, VSYNC, a data enable signal DE, and a main clock MCLK that are externally provided. The timing controller 110 also provides the data driver 140 with data driving signals LOAD and STH to output the compensated gray data Gn-1' and provides the gate driver 160 with gate driving signals GATE CLK and STV to output the compensated gray data Gn-1'.

The timing controller 110 receives a compensation data Gc for improving the response speed of the liquid crystal via the first memory 120 and stores the compensation data Gc in the LUT. The timing controller 110 may further include a separate memory (not shown) to store the compensation data Gc in the LUT:

The timing controller 110 receives a peripheral temperature signal T measured by the temperature sensor 90 and the source gray data Gn from an external image source and generates the compensated gray data Gn-1' of the preceding frame based on the compensation data Gc in the LUT, the gray data Gn of a current frame and a gray data Gn-1 of the preceding frame. The compensated gray data Gn-1' of the preceding frame is output to the data driver 140 as a data signal.

The first memory 120 temporarily stores the compensation data Gc and provides the stored compensation data Gc to the timing controller 110 in response to a request of the timing controller 110. When the temperature changes, the first memory 120 temporarily stores the compensation data Gc corresponding to the changed temperature. The first memory 120 may be provided externally and provides the stored compensation data Gc to the timing controller 110 in response to a request of the timing controller 110.

The second memory 130 stores the source gray data externally provided thereto. The second memory 130 may include two logical memory banks 132, 134. When a source gray data corresponding to one half of the preceding frame is written in the memory bank 132, the memory bank 134 reads out the source gray data corresponding to one half of the source gray data, or vice versa. The memory banks 132 and 134 enable the written-in operation and the read-out operation of the second memory 130 to be sequentially performed.

The data driver 140 receives the compensated gray data Gn-1' of the preceding frame from the timing controller 110 and converts the compensated gray data Gn-1' to a corresponding gray voltage (or data voltage or data signal) to transmit and apply the converted data signal D1, D2, . . . , Dm to the liquid crystal panel 150.

The liquid crystal panel 150 displays an image through a liquid crystal layer that is positioned between an array substrate and a color filter substrate corresponding to the array substrate. The liquid crystal panel 150 includes a plurality of gate lines (or scan line) for providing a gate signal and a plurality of data lines (or source line) for providing the converted data signal D1, D2, . . . , Dm. A pixel is formed in an area defined by the gate lines and the data lines, respectively. The pixel includes a thin film transistor (TFT) having gate and source electrodes that are coupled with the gate line and the data line, respectively, a liquid crystal capacitor Clc and a storage capacitor Cst each having one end coupled with a drain electrode of the thin film transistor, respectively.

The gate driver 160 activates the gate line based on the gate driver signal GATE CLK and STV and provides the gate signals S1, S2, S3, . . . , Sn to turn on the thin film transistor.

The voltage generator 170 controls a power that is applied to the liquid crystal display device. The liquid crystal display device may be controlled using the voltage generator 170 when the compensation data Gc adjusted according to the temperature in the LUT is written or stored to the first memory (EEPROM) 120, which prevents the liquid crystal display device from malfunctioning.

Although the discussion herein mostly describes that the digital liquid crystal display device receives digital gray data from an external source, it is well known to those skilled in the art that the present invention may also be applied to other display devices, such as an analog liquid crystal display device having an interface for converting an analog gray data that is externally provided to a digital gray data.

In addition, the discussion herein mostly describes that the liquid crystal display device receives the source gray data from the image signal source and the compensation data adjusted by the temperature for improving the response speed of the liquid crystal. However, it is understood that the liquid crystal display device may alternatively receive only the source gray data from the image signal source and may detect an interior temperature of the liquid crystal display device to compensate the source gray data according to the detected temperature.

In the above described liquid crystal display device, the liquid crystal display device may include a plurality of LUTs for storing the compensation data for respective temperature intervals and one LUT is selected that corresponds to a detected temperature to compensate for the temperature so that the response speed of the liquid crystal may be maintained.

Figure 2:
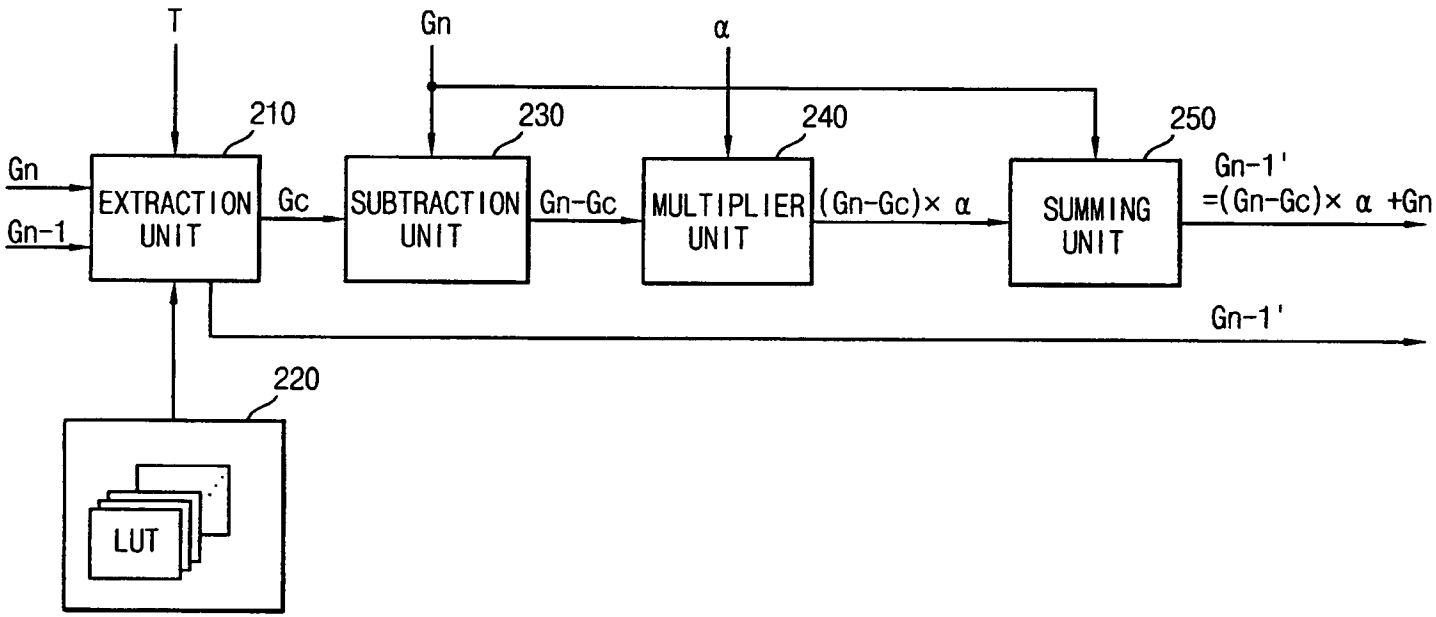
FIG. 2 is a block diagram showing a timing controller in FIG. 1 according to a first embodiment of the invention.

FIG. 2 is a block diagram illustrating the timing controller 110 in FIG. 1 according to a first embodiment of the invention.

Referring to FIG. 1 and FIG. 2, the timing controller 110 may include an extraction unit 210, a memory 220, a subtraction unit 230, a multiplier unit 240, and a summation unit 250.

The extraction unit 210 receives a peripheral temperature T, a current gray data Gn, and a preceding gray data Gn-1, and extracts a LUT that compensates the gray according to a temperature interval including the peripheral temperature T from the memory 220 to output the compensated gray data Gn-1' from the extracted LUT based on the current gray data Gn and the preceding gray data Gn-1.

When the LUT that compensates the gray according to the temperature interval corresponding to the peripheral temperature T does not exist in the memory 220, the LUT that compensates the gray according to a temperature that is approximating the same as peripheral temperature T is extracted and the compensation data Gc is output from the extracted LUT to the subtraction unit 230 based on the current gray data Gn and the preceding gray data Gn-1.

The memory 220 stores a plurality of LUTs that compensate the gray defined by optimal compensation data to improve the response speed of the liquid crystal according to a peripheral temperature interval. The memory 220 may be a ROM or an EEPROM. For example, when the peripheral temperature is between about 0 to about 40° C., the compensation data optimized for the interval of the peripheral temperature is stored in the memory 220 and includes optimized data for intervals of about 0 to 5° C., about 10 to 15° C., about 20 to 25° C., and about 30 to 35° C. The compensation data for the interval of the peripheral temperatures or about 5 to 10° C., about 15 to 20° C., about 25 to 30° C. and about 35 to 40° C. are calculated as will be described later.

The subtraction unit 230 subtracts the compensation data Gc from the current gray data Gn and generates difference data Gn−Gc relating to a difference between the current gray data and the compensation data. The difference data Gn−Gc may be a negative number, zero, or a positive number.

The multiplier unit 240 multiplies the difference data Gn−Gc by a compensation proportion parameter $\alpha$ that may be externally provided and outputs a temperature compensation value $(Gn-Gc)\times\alpha$ to the summing unit 250.

The compensation proportion parameter $\alpha$ may be used to generate an extended (or calculated) LUT by multiplying an overdrive value of a default LUT. For example, the compensation proportion parameter $\alpha$ may range from about 0 to about 3.5 with a unit of about 0.5. In addition, the compensation proportion parameter $\alpha$ may be predefined as a default of the respective LUTs and alternatively, may have a changing value according to respective gray levels in one LUT.

The compensation proportion parameter $\alpha$ may have three bits. Alternatively, the bit number of the compensation proportion parameter $\alpha$ may extend so that the binary bit decimal location increases, which improves the precision of the temperature compensation. When the compensation proportion parameter $\alpha$ has three bits, the upper two bits are locations for integer and the lower one bit is a location for a decimal. For example, a binary bit value '011' of the compensation proportion parameter $\alpha$ represents 1.5 (namely, the difference data (Gn−Gc) is multiplied by 1.5) and a binary bit value '101' represents 2.5.

The summation unit 250 sums up the temperature compensation value $(Gn-Gc)\times\alpha$ and the current gray data Gn and outputs the compensated gray data Gn-1' of the preceding frame.

According to the first embodiment of the invention, the optimal gray compensation LUT for a predetermined temperature interval is determined among the plurality of the LUTs stored in the ROM or the EEPROM of the timing controller 110 according to the peripheral temperature and the gray data is compensated using the optimal gray compensation LUT. Alternatively, the plurality of the gray compensation LUTs are generated using the compensation proportion parameter $\alpha$ and the gray data is compensated using the generated gray compensation LUTs. The compensation proportion parameter $\alpha$ may have a varying value such as $\alpha 0$, $\alpha 1$, $\alpha 2$, $\alpha 3$, . . . , that may be designated by a register of the EEPROM. The gray compensation LUT generated based on the compensation proportion parameter $\alpha$ may have a value, for example, n (n is a real number) times of a default LUT.

For example, one LUT, which has an optimized overdrive value for an external temperature, may be selected from among a plurality of default LUTs and a plurality of calculated LUTs according to a value applied to a pin for selecting the LUT.

For example, the pin for selecting the LUT may have three pins and when a binary value of '000' is applied to the three pins, the LUT having overdrive data for over-compensation corresponding to the lowest temperature is selected and when a binary value of '111' is applied to the three pins, the LUT having the overdrive data for under-compensation corresponding to the highest temperature is selected.

Figure 3:
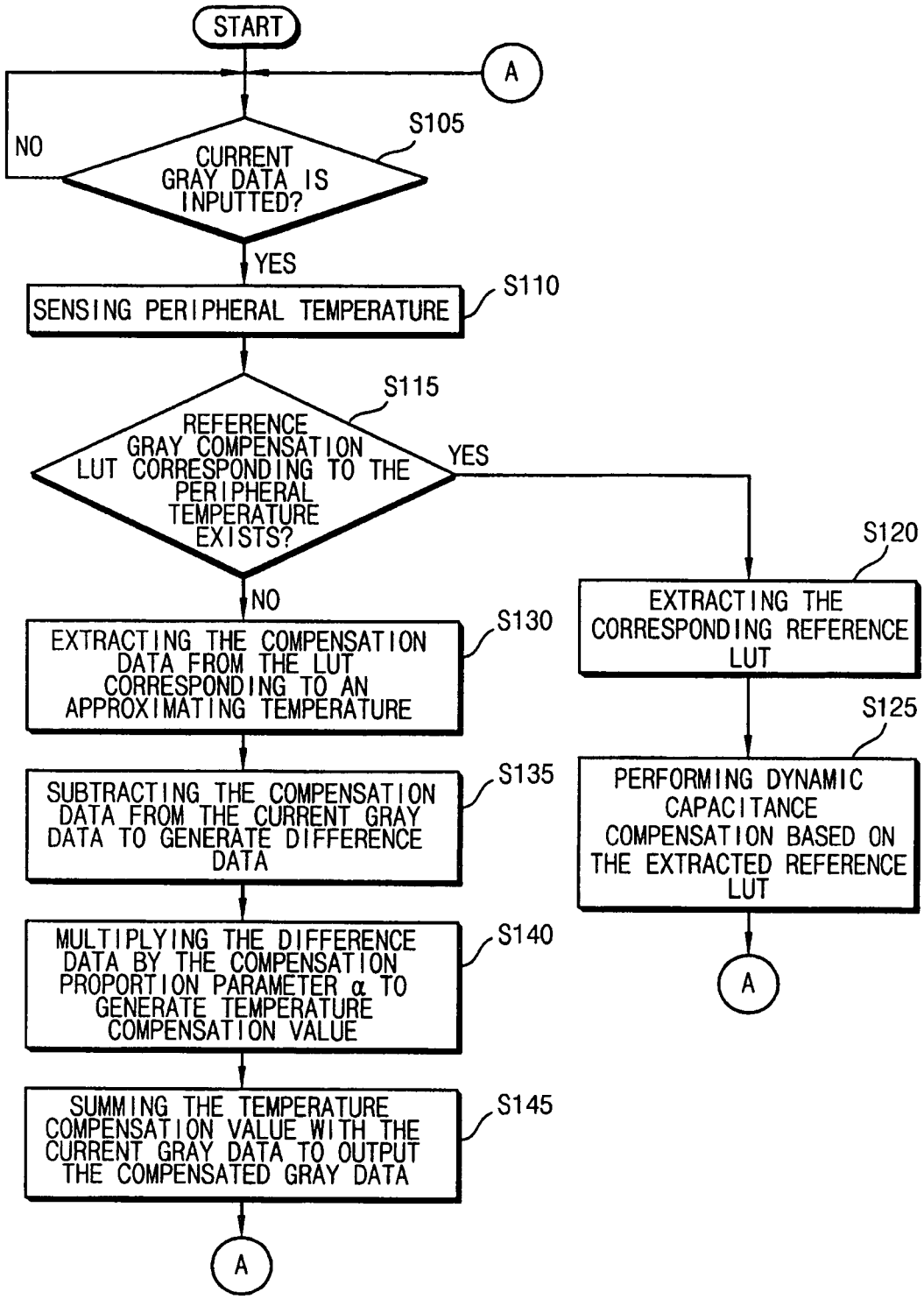
FIG. 3 is a flowchart showing a method of driving a liquid crystal display device according to the first embodiment of the invention.

FIG. 3 is a flowchart illustrating a method of driving a liquid crystal display device according to the first embodiment of the invention.

Referring to FIG. 3, in operation S105, it is determined whether the current gray data Gn is input from an external source.

When the current gray data Gn is not input, operation S105 is repeated. When the current gray data Gn is input, the peripheral temperature (T) is sensed in operation S110. For example, the peripheral temperature (T) may correspond to a temperature data that is externally provided or to temperature sensed by the liquid crystal display device.

In operation S115, it is determined whether a reference gray compensation LUT corresponding to the peripheral temperature (T) exists.

When the reference gray compensation LUT corresponding to the peripheral temperature (T) is determined to exist, the corresponding reference gray compensation LUT is extracted in operation S120 and the dynamic capacitance compensation is performed based on the extracted reference gray compensation LUT in operation S125. The process then proceeds back to operation S105.

When the reference gray compensation LUT corresponding to the peripheral temperature (T) is determined not to exist, the compensation data Gc is extracted from the LUT corresponding to a temperature approximating the peripheral temperature (T) in operation S130.

In operation S135, the compensation data Gc is subtracted from the current gray data Gn to generate the difference data Gn−Gc and in operation S140 the difference data Gn−Gc is multiplied by the compensation proportion parameter α to generate the temperature compensation value (Gn−Gc)×α.

In operation S145, the temperature compensation value (Gn−Gc)×α is summed with the current gray data Gn to output the compensated gray data Gn-1' of the preceding frame.

The method of improving the response speed of the liquid crystal described above according to the first embodiment of the invention is summarized below.

When the peripheral temperature is assumed to be between about 0° C. to about 40° C., the temperature interval having a default compensation data is set at about 0° C. to about 5° C., about 10° C. to about 15° C., about 20° C. to about 25° C. and about 30° C. to about 35° C. The compensation data for the temperature interval of about 5° C. to about 10° C., about 15° C. to about 20° C., about 25° C. to about 30° C. and about 35° C. to about 40° C. are calculated, respectively.

When the peripheral temperature (T) is sensed at about 17° C., a previous gray data Gn-1 has 32 gray levels and the current gray data has 64 gray levels, a corresponding compensation data Gc (for example, 72 gray level) is output using the gray compensation LUT for the temperature of about 10° C. to about 15° C. A gray difference between the current gray data Gn and the compensation data Gc is then multiplied by the compensation proportion parameter α to determine a final overdrive value. The final overdrive value is summed with the current gray data Gn and output as the compensated gray data to the data line.

For example, the compensation proportion parameter α may be calculated using the following expression 1.

$$\alpha = Gn'_{LUT2} - Gn'_{LUT1} / T_{LUT2} - T_{LUT1} \qquad \text{Expression 1}$$

G'n_LUT2 is the gray data extracted from the LUT corresponding to a temperature that is higher than the peripheral temperature (T), G'_LUT1 is the gray data extracted from the LUT corresponding to a temperature that is lower than the peripheral temperature (T), T_LUT2 is the temperature that is higher than the peripheral temperature (T), and T_LUT1 is the temperature that is lower than the peripheral temperature (T).

For example, when the compensation proportion parameter α is 1.5, the gray difference between the current gray data Gn and the corresponding compensation data Gc is +8 gray level (i.e., 74−62 gray level) so that the overdrive results in +12 gray level.

Therefore, the compensated gray data Gn-1' corresponding to a summation over 64 gray level of the current gray data Gn and +12 gray level of the overdrive, namely 76 gray level, is output.

On the other hand, when the peripheral temperature (T) is sensed at about 17° C., the previous gray data Gn-1 has 64 gray level, and the current gray data has 32 gray level, a corresponding compensation data Gc (for example, 25 gray level) is output using the gray compensation LUT for the temperature of about 10° C. to about 15° C.

When the compensation proportion parameter α is 1.5, the gray difference between the current gray data Gn and the corresponding compensation data Gc is −7 gray level (i.e., 25−32 gray level) so that the overdrive results in −11 gray level.

Therefore, the compensated gray data Gn-1' that is finally output has a gray level that is a summation of a 32 gray level of the current gray data Gn and a −11 gray level of the overdrive to which the compensation proportion parameter α is applied, resulting in a 21 gray level.

As described above, in the first embodiment, one compensation proportion parameter α is applied to corresponding entire gray levels. However, the compensation proportion parameter α may be adjusted according to the gray level to more precisely perform the temperature compensation.

For example, when a 16×16 gray compensation LUT for 16 previous gray data Gn-1 and 16 current gray data Gn is used, the compensation proportion parameter α may vary according to gray levels on a scale of four or eight, etc.

When the compensation proportion parameter has varying value according to respective set of the gray levels, the gray compensation may be linearly performed in the set of the gray level so that the gray compensation data values may be optimized for the temperature.

For example, when entire gray level corresponds to a 256-gray level, a compensation proportion parameter α1 may be applied to 0 to 63 gray levels, a compensation proportion parameter α2 to 64 to 127 gray levels, a compensation proportion parameter α3 to 128 to 191 gray levels, and a compensation proportion parameter α4 to 192 to 255 gray levels.

Figure 4:
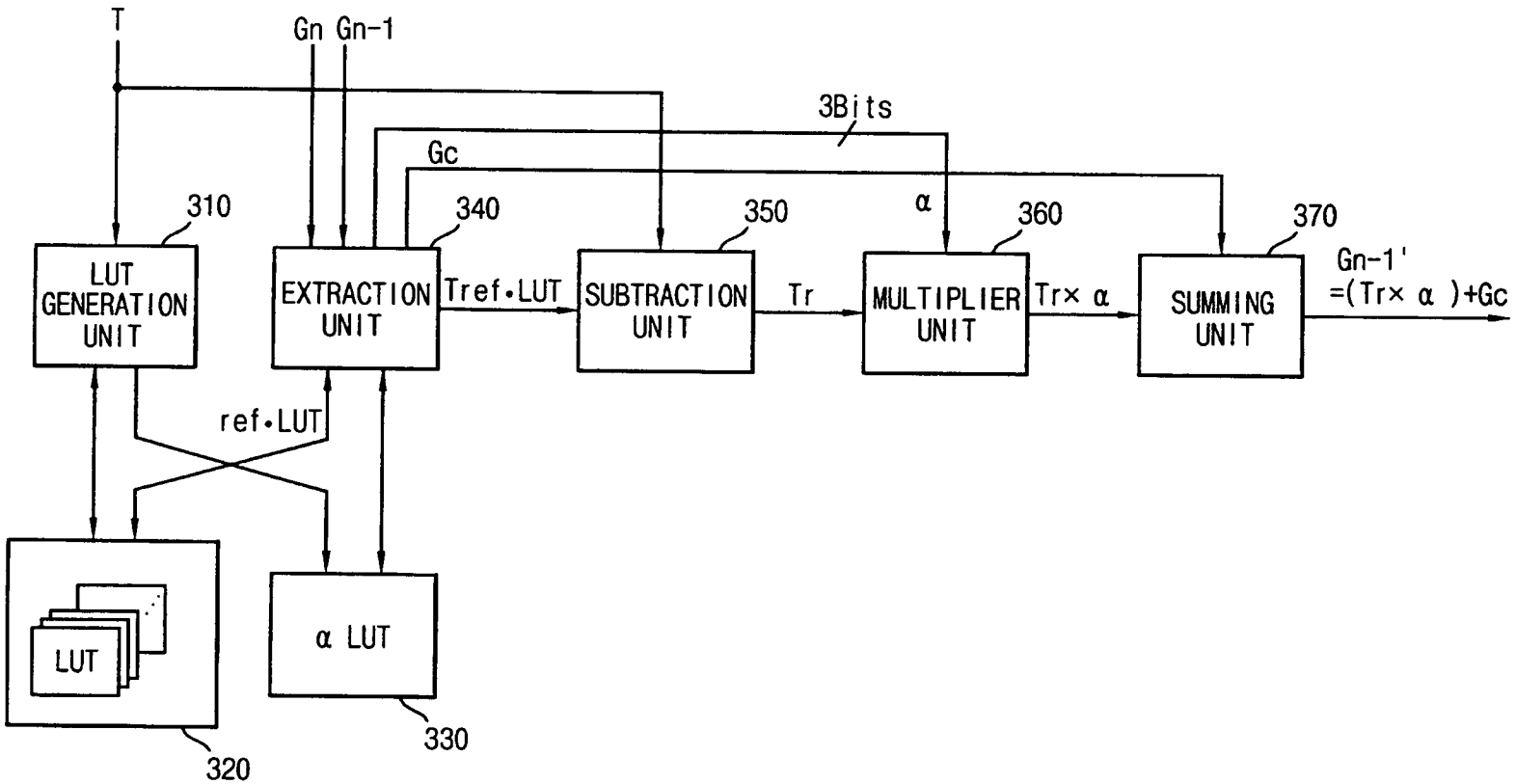
FIG. 4 is a block diagram showing a timing controller in FIG. 1 according to a second embodiment of the invention.

FIG. 4 is a block diagram illustrating the timing controller 110 in FIG. 1 according to a second embodiment of the invention.

Referring to FIG. 1 and FIG. 4, the timing controller 110 according to the second embodiment of the invention may include an LUT generation unit 310, a first memory 320, a second memory 330, an extraction unit 340, a subtraction unit 350, a multiplier unit 360 and a summation unit 370.

For illustrative purposes and purposes of convenience, the description of extracting the gray compensation LUT corresponding to the temperature interval including the peripheral temperature (T) and outputting the compensated gray data Gn-1' of the preceding frame from the extracted LUT based on the current gray data Gn and the previous gray data Gn-1 are omitted as necessary.

When the peripheral temperature (T) is provided, the LUT generation unit 310 extracts two gray compensation LUTs corresponding to the temperature interval approximating the peripheral temperature (T) from the first memory 320 and calculates the compensation proportion parameter α based on the two extracted gray compensation LUTs. A plurality of the calculated compensation proportion parameters a are stored in the second memory 330, for example, in αLUT.

The first memory 320 may store the plurality of the gray compensation LUTs defined by optimal compensation data for improving the response speed of the liquid crystal according to the peripheral temperature interval. The first memory 520 may be a ROM or an EEPROM. For example, when the peripheral temperature is assumed to be between about 0° C. to about 40° C., the temperature interval having a default compensation data is set at about 0° C. to about 5° C., about 10° C. to about 15° C., about 20° C. to about 25° C. and about 30° C. to about 35° C., respectively.

The second memory 330 may store the compensation proportion parameter α in the αLUT based on two extracted gray compensation LUTs according to the peripheral temperature (T). The second memory 330 may be a ROM or a EEPROM.

The extraction unit 340 extracts the compensation proportion parameter α from the αLUT stored in the second memory 330 and provides the extracted compensation proportion parameter α to the multiplier unit 360. Additionally, the extraction unit 340 extracts the compensation data Gc from the reference gray compensation LUT of the first memory 320 based on the compensation proportion parameter α and provides the compensation data Gc to the summation unit 370.

The reference gray compensation LUT is the gray compensation LUT corresponding to a temperature that is closest to the peripheral temperature (T). The extraction unit 340 extracts a reference temperature data Tref.LUT corresponding to the reference gray compensation LUT and provides the reference temperature data Tref.LUT to the subtraction unit 350.

The subtraction unit 350 generates a temperature ratio data Tr based on a difference between a current temperature data (T) and the reference temperature data Tref.LUT and provides the temperature ratio data Tr to the multiplier unit 360.

The multiplier unit 360 multiplies the temperature ratio data Tr by the compensation proportion parameter α to generate a temperature compensation value Tr×α and provides the temperature compensation value Tr×α to the summation unit 370.

The summation unit 370 sums the compensation data Gc and the temperature compensation value Tr×α and outputs the compensated gray data Gn-1' of the preceding frame.

FIG. 5A shows the gray compensation look-up table (LUT) when a peripheral temperature is about 20° C. FIG. 5B is the gray compensation LUT when a peripheral temperature is about 30° C. FIG. 5C is an LUT having the compensation proportion parameter α corresponding to a neighboring temperature interval.

It is assumed that the previous gray data Gn-1 has a 112 gray level, the current gray data Gn has a 32 gray level and the peripheral temperature is about 25° C. Further, the compensation proportion parameter α between two LUTs is assumed to have three bits and the temperature ratio data Tr is four bits.

Under the above conditions, the compensation proportion parameter α is shown as 0.5 (=0.102) in the αLUT in FIG. 5C. Namely, when the gray level is changed from the 112 gray level to the 32 gray level in the temperature interval of about 20° C. to about 30° C., the gray compensation value has the compensation proportion parameter α of about 0.5 according to the temperature.

Since the peripheral temperature is about 25° C., the gray compensation value Gn' of 10 (=000010102) is extracted from the reference gray compensation LUT corresponding to a temperature of about 20° C. approaching a temperature of about 25° C.

Since the temperature ratio Tr is about 25° C. and the reference gray compensation LUT (i.e., the reference temperature data Tref.LUT) corresponds to about 20° C., the difference therebetween (i.e., Tr) is about 5 (=01012) ° C. and the temperature compensation value Tr×α is (0.102)×(01012)= 000000102.

The compensated gray data Gn-1' of the preceding frame is obtained by adding the compensation data Gn' of the reference gray compensation LUT and the compensation value Tr×α so that the compensated gray data Gn-1' of the preceding frame finally output is 000010102+000000102=000011002.

It is assumed in the example below that the previous gray data Gn-1 has a 32 gray level, the current gray data Gn has a 112 gray level, and the peripheral temperature is about 23° C. Further, it is assumed that the compensation proportion parameter α between two LUTs has three bits and the temperature ratio data Tr has four bits.

Under the above described condition, the compensation proportion parameter α is shown as 0.9 (=1.002) in the ALUT in FIG. 5C. Namely, when the gray level is changed from the 32 gray level to the 112 gray level in the temperature interval of about 20° C. to about 30° C., the gray compensation value has the compensation proportion parameter α of about −0.9 (=−1.002) according to the temperature.

Since the peripheral temperature is about 23° C., the gray compensation value Gn' of 144 (=100100002) is extracted from the reference gray compensation LUT corresponding to a temperature of 20° C. approaching a temperature of about 25° C.

Since the temperature ratio Tr is about 23° C. and the reference gray compensation LUT (i.e., the reference temperature data Tref.LUT) corresponds to a temperature of about 20° C., the difference therebetween (i.e., Tr) is about 3 (=00112) ° C. and the temperature compensation value Tr×α is (−1.002)×(00112)=−000000112.

The compensated gray data Gn-1' of the preceding frame is obtained by adding the compensation data Gn' of the reference gray compensation LUT and the compensation value Tr×α a so that the compensated gray data Gn-1' of the preceding frame finally output is 100100002+000000112=100011012 (i.e., 141).

Figure 6A:
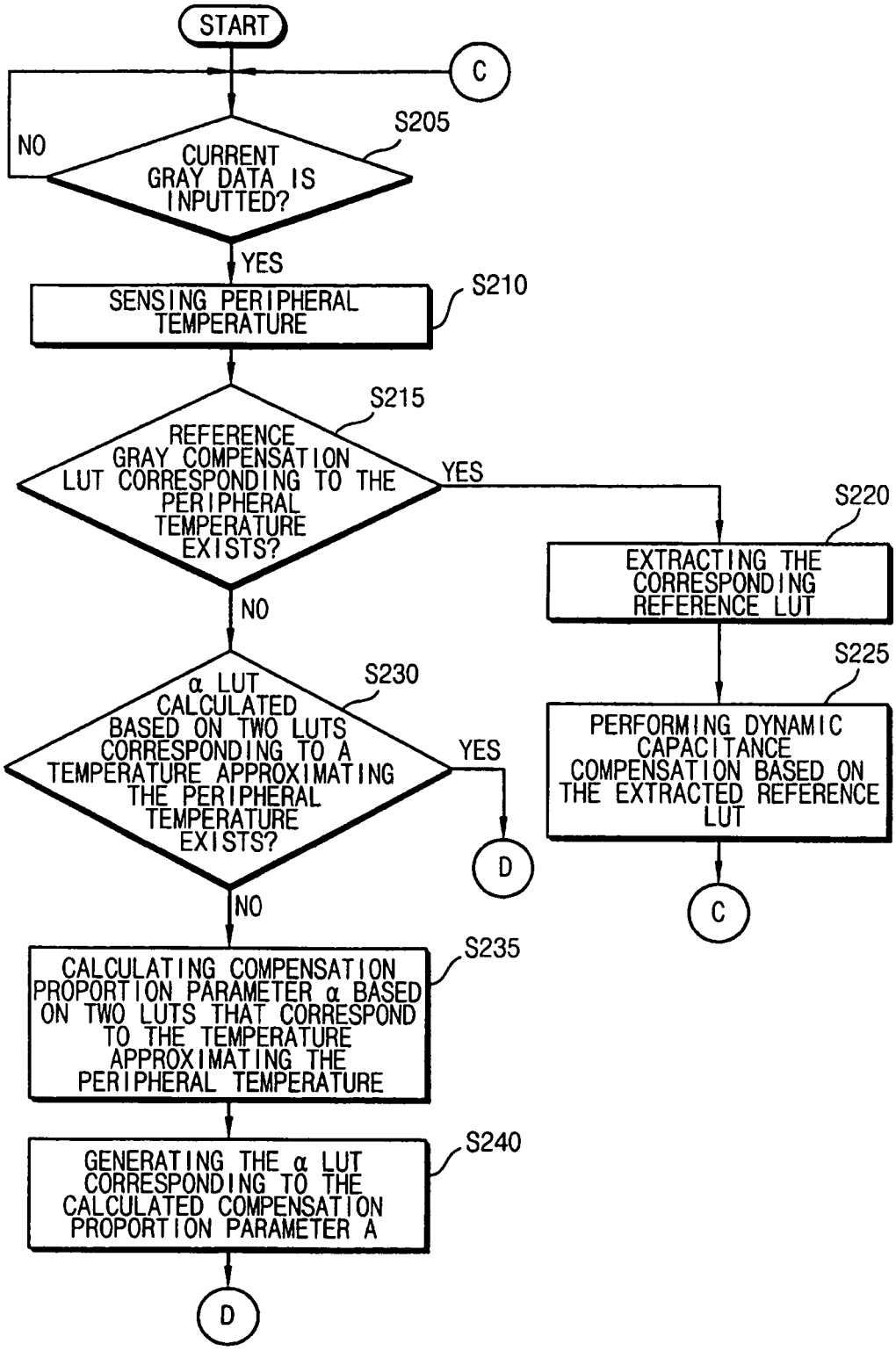
FIG. 6A and FIG. 6B are a flowchart showing a method of driving a liquid crystal display device according to the second exemplary embodiment of the invention.
Figure 6B:
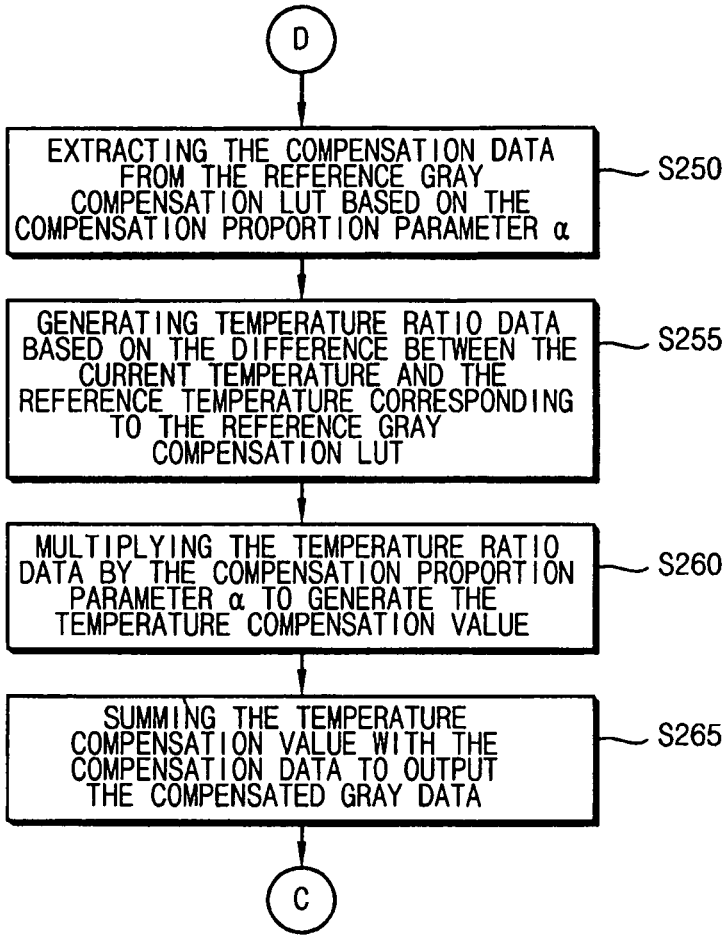

FIG. 6A and FIG. 6B are a flowchart showing a method of driving a liquid crystal display device according to the second embodiment of the invention.

Referring to FIG. 6A and FIG. 6B, whether the current gray data Gn is input from an external is determined in operation S205.

When the current gray data Gn is not input, operation S205 is repeated. When the current gray data Gn is input, the peripheral temperature (T) is sensed in operation S210. The peripheral temperature (T) may correspond to the temperature data that is externally provided or to a temperature sensed by the liquid crystal display device.

In operation S215, it is determined whether the reference gray compensation LUT corresponding to the peripheral temperature (T) exists.

When the reference gray compensation LUT corresponding to the peripheral temperature (T) is determined to exist, the corresponding reference gray compensation LUT is extracted in operation S220 and the dynamic capacitance compensation is performed based on the extracted reference gray compensation LUT in operation S225. The process then proceeds to operation S205.

When the reference gray compensation LUT corresponding to the peripheral temperature (T) is determined not to exist, whether the αLUT having the compensation proportion parameter α calculated based on two LUTs that correspond to a temperature approximating the peripheral temperature (T) exists is determined in operation S230. The temperature approximating the peripheral temperature (T) includes a temperature that is lower than and approaching the peripheral temperature (T) and a temperature that is higher than and approaching the peripheral temperature (T).

When the αLUT is determined not to exist, the compensation proportion parameter α is calculated based on two LUTs that correspond to the temperature approximating the peripheral temperature (T) in operation S235.

The αLUT corresponding to the calculated compensation proportion parameter α is then generated and may be stored in the memory in operation S240.

When the αLUT is determined to exist, the compensation data is extracted from the reference gray compensation LUT based on the compensation proportion parameter α extracted from the αLUT in operation S250.

The temperature ratio data Tr is then generated based on the difference between the current temperature data (T) and the reference temperature data Tref.LUT corresponding to the reference gray compensation LUT in operation S255.

The temperature ratio data Tr is multiplied by the compensation proportion parameter α to generate the temperature compensation value Tr×α in operation S260.

The temperature compensation value Tr×α is added with the compensation data Gc to output the compensated gray data Gn-1' of the preceding frame in operation S265.

Figure 7:
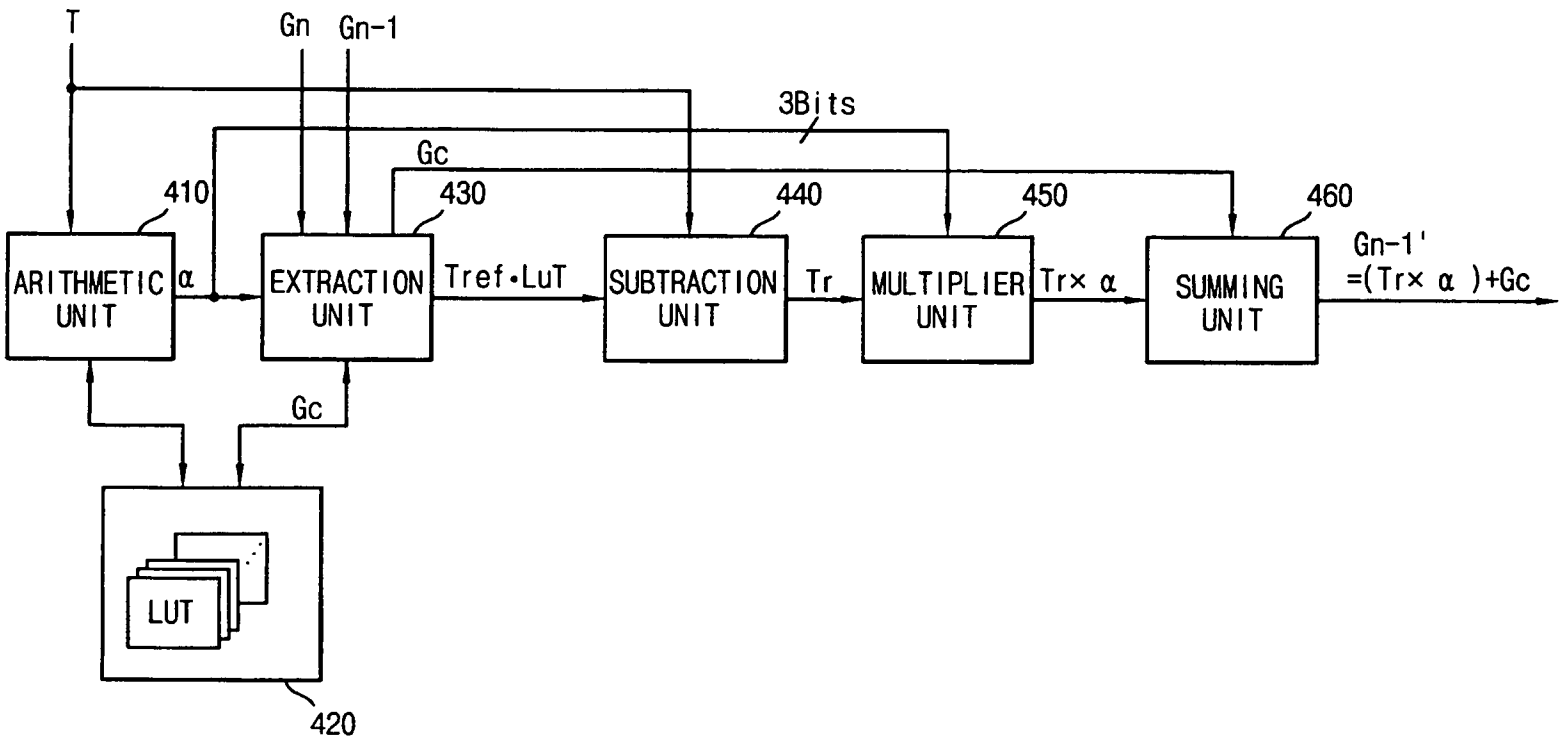
FIG. 7 is a block diagram illustrating a timing controller in FIG. 1 according to a third embodiment of the invention.

FIG. 7 is a block diagram illustrating the timing controller 110 in FIG. 1 according to a third embodiment of the invention.

Referring to FIG. 1 and FIG. 7, the timing controller 110 may include an arithmetic unit 410, a first memory 420, an extraction unit 430, a subtraction unit, a multiplier unit 450 and a summation unit 460. For illustrative purposes and purposes of convenience, the description of extracting the gray compensation LUT for the temperature interval including the peripheral temperature (T) and outputting the compensated gray data Gn-1' of the preceding frame from the extracted LUT based on the current gray data Gn and the previous gray data Gn-1 are omitted as necessary.

When the peripheral temperature (T) is provided, the arithmetic unit 410 calculates the compensation proportion parameter α in real time based on two LUTs corresponding to the temperature approximating the peripheral temperature (T) from among a plurality of the gray compensation LUTs stored in the first memory 420. The calculated compensation proportion parameter α is provided to the extraction unit 420 and the multiplier unit 450.

The first memory 420 stores the plurality of the gray compensation LUTs having respective compensation data corresponding to predetermined temperature intervals, which are optimized for improving the response speed of the liquid crystal. The first memory may be a ROM or an EEPROM. For example, when the peripheral temperature is assumed to be between about 0° C. to about 40° C., the temperature intervals having a default compensation data are set as about 0° C. to about 5° C., about 10° C. to about 15° C., about 20° C. to about 25° C. and about 30° C. to about 35° C.

The extraction unit 430 receives the current gray data Gn and the previous gray data Gn-1 that are externally provided and extracts the compensation data Gc based on the compensation proportion parameter α from one of the reference gray compensation LUTs stored in the first memory 420 and provides the compensation data Gc to the summation unit 460. The extraction unit 430 extracts the reference temperature data Tref.LUT corresponding to the reference gray compensation LUT and provides the reference temperature data Tref.LUT to the subtraction unit 440.

The subtraction unit 440 generates the temperature ratio data Tr based on the difference between the current temperature data (T) and the reference temperature data Tref.LUT and provides the temperature ratio data Tr to the multiplier unit 450.

The multiplier unit 450 multiplies the temperature ratio data Tr by the compensation proportion parameter α to generate the temperature compensation value Tr×α and provides the temperature compensation value Tr×α to the summation unit 460.

The summation unit 460 sums the compensation data Gc and the temperature compensation value Tr×α and outputs the compensated gray data Gn-1' of the preceding frame.

Figure 8:
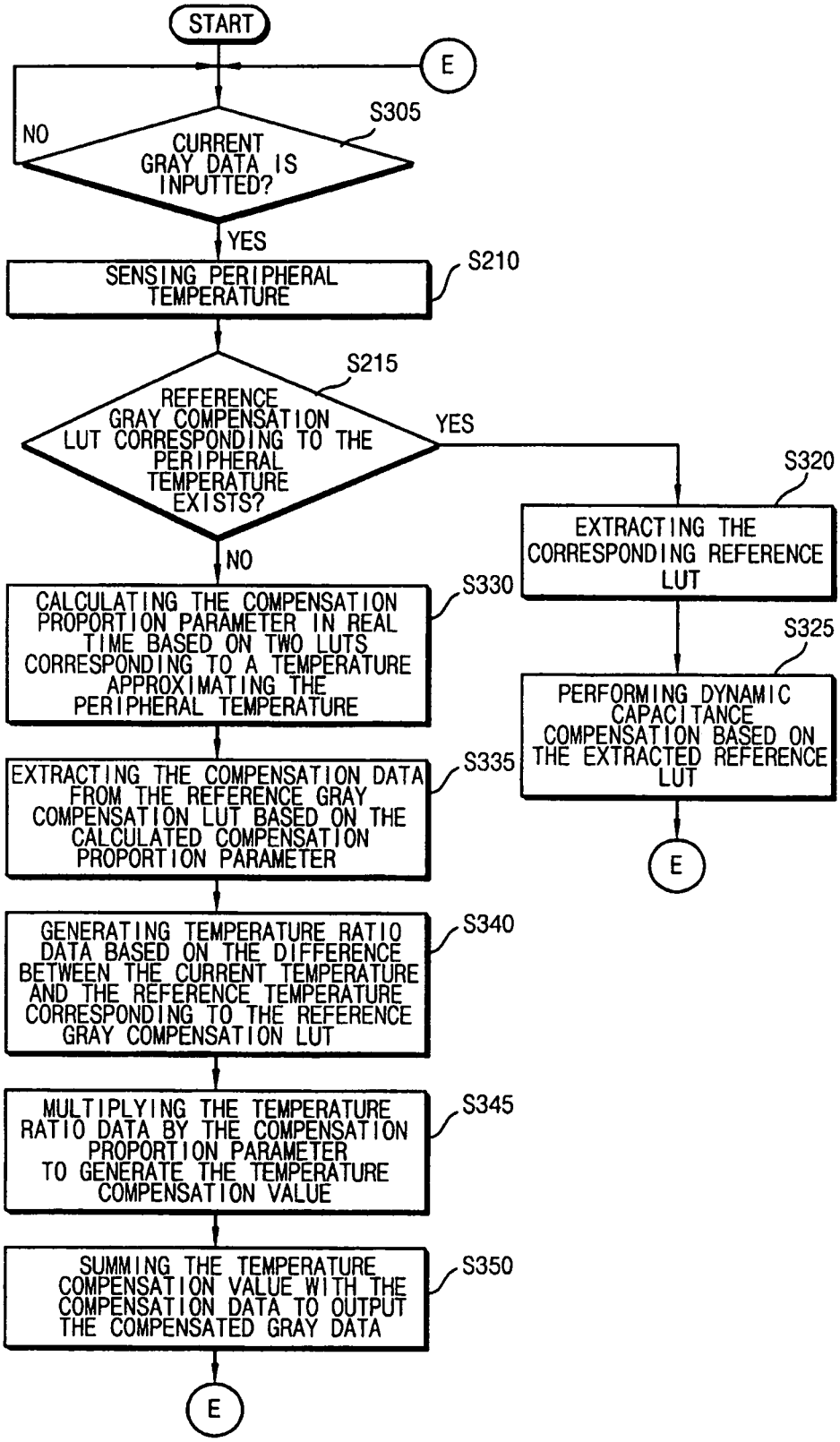
FIG. 8 is a flowchart illustrating a method of driving a liquid crystal display device according to the third embodiment of the invention.

FIG. 8 is a flowchart showing a method of driving a liquid crystal display device according to the third embodiment of the invention.

Referring to FIG. 8, whether the current gray data Gn is input from an external is determined in operation S305.

When the current gray data Gn is not input, operation S305 is repeated. When the current gray data Gn is input, the peripheral temperature (T) is sensed in operation S310. The peripheral temperature (T) may correspond to the temperature data that is externally provided or to a temperature sensed by the liquid crystal display device.

In operation S315 it is determined whether the reference gray compensation LUT corresponding to the peripheral temperature (T) exists.

When the reference gray compensation LUT corresponding to the peripheral temperature (T) is determined to exist, the corresponding reference gray compensation LUT is extracted in operation S320 and the dynamic capacitance compensation is performed based on the extracted reference gray compensation LUT in operation S325. The process then proceeds to operation S305.

When the reference gray compensation LUT corresponding to the peripheral temperature (T) is determined not to exist, the compensation proportion parameter α is calculated in real time based on two LUTs that correspond to a temperature approximating the peripheral temperature (T) in operation S330. The temperature approximating the peripheral temperature (T) includes a temperature that is lower than and approaching the peripheral temperature (T) and a temperature that is higher than and approaching the peripheral temperature (T).

The compensation data Gc is extracted from the reference gray compensation LUT based on calculated the compensation proportion parameter α in operation S335.

The temperature ratio data Tr is generated based on the difference between the current temperature data (T) and the reference temperature data Tref.LUT corresponding to the reference gray compensation LUT in operation S340.

The temperature ratio data Tr is multiplied by the compensation proportion parameter α to generate the temperature compensation value Tr×α in operation S345. The temperature compensation value Tr×α is added with the compensation data Gc to output the compensated gray data Gn-1' of the preceding frame in operation S350.

As described above, according to the first embodiment of the invention, a plurality of LUTs for predefined temperature intervals are provided and when the peripheral temperature is included in one of the predetermined temperature intervals, the compensation data is output from the gray compensation LUT for a corresponding temperature interval so that the response speed of the liquid crystal improves according to the temperature.

When the peripheral temperature is not included in the predefined temperature intervals, the compensation data is extracted from the gray compensation LUT corresponding to a temperature approaching to the peripheral temperature and a difference data is generated based on a difference between the current gray data and the compensation data. The gray difference data is multiplied by the compensation proportion parameter to generate the temperature compensation value and the temperature compensation value is added with the current gray data so that the response speed of the liquid crystal according to the temperature may be improved while a memory capacity is reduced.

According to the second embodiment of the invention, the plurality of LUTs for certain temperature intervals are provided and when the peripheral temperature is included in one of the certain temperature intervals, the compensation data is output from the gray compensation LUT for a corresponding temperature interval so that the response speed of the liquid crystal improves according to the temperature.

When the peripheral temperature is not included in any of the predetermined temperature intervals, the compensation proportion parameter is calculated based on two LUTs corresponding to a temperature approximating the peripheral temperature to generate the compensation proportion parameter LUT. The compensation data is extracted from the gray compensation LUT selected based on the compensation proportion parameter extracted from the compensation proportion parameter LUT. The temperature ratio data is generated based on the difference between the current temperature data and the reference temperature data corresponding to the reference gray compensation LUT. The temperature ratio data is multiplied by the compensation proportion parameter to generate the temperature compensation value. The temperature compensation value is added with the current gray data to output the compensated gray data of the preceding frame so that the response speed of the liquid crystal according to the temperature may be improved while a memory capacity is reduced.

According to the third embodiment of the invention, the plurality of LUTs for certain temperature intervals are provided and when the peripheral temperature is included in any of the certain temperature intervals, the compensation data is output from the gray compensation LUT for a corresponding temperature interval so that the response speed of the liquid crystal improves according to the temperature.

When the peripheral temperature is not included in any of the certain temperature intervals, the compensation proportion parameter is calculated in real time based on two LUTs corresponding to a temperature approximating the peripheral temperature. And, the compensation data is extracted from the gray compensation LUT selected based on the compensation proportion parameter. The temperature ratio data is generated based on the difference between the current temperature data and the reference temperature data corresponding to the reference gray compensation LUT. The temperature ratio data is multiplied by the compensation proportion parameter to generate the temperature compensation value. The temperature compensation value is added with the current gray data to output the compensated gray data Gn-1' of the preceding frame so that the response speed of the liquid crystal according to the temperature may be improved while a memory capacity is reduced.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display device, comprising:

a liquid crystal display unit; and a controller that includes a plurality of gray compensation look-up tables (LUTs) respectively corresponding to a plurality of temperature intervals, wherein the controller comprises:

a memory storing the gray compensation LUTs;

an extraction unit extracting compensation data from the gray compensation LUTs;

a subtraction unit generating difference data;

a multiplier unit multiplying the difference data by a compensation proportion parameter to generate a temperature compensation value; and a summation unit generating compensated gray data, wherein when a peripheral temperature of the display device is included in at least one of the temperature intervals, the extraction unit extracts first compensation data from the gray compensation LUT corresponding to the temperature interval that includes the peripheral temperature, and outputs the first compensation data to the liquid crystal display unit as compensated gray data, wherein when the peripheral temperature of the display device is not included in any of the temperature intervals, the extraction unit extracts a second compensation data from the gray compensation LUT corresponding to one of the temperature intervals having a temperature approximating the peripheral temperature, the subtraction unit generates the difference data relating to a difference between current gray data and the second compensation data, the multiplier unit multiplies the difference data by the compensation proportion parameter to generate the temperature compensation value, and the summation unit sums the temperature compensation value and the current gray data to generate the compensated gray data, wherein if Gn represents the current gray data and if Gc represents the second compensation data, the difference data generated from the subtraction unit is Gn−Gc.

2. The display device of claim 1, wherein the controller comprises:

a first memory storing a plurality of gray compensation LUTs according to predetermined temperature intervals, respectively;

a LUT generation unit extracting two gray compensation LUTs corresponding to the temperature interval approximating the peripheral temperature and generating a LUT based on a calculated compensation proportion parameter;

a second memory storing the a LUT;

an extraction unit extracting the compensation data from the corresponding gray compensation LUT in the first memory based on the compensation proportion parameter extracted from the a LUT in the second memory;

a subtraction unit generating a temperature ratio data based on a difference between a temperature of the corresponding gray compensation LUT and the peripheral temperature;

a multiplier unit multiplying the temperature ratio data by the compensation proportion parameter to generate a temperature compensation value; and a summation unit summing the temperature compensation value and the compensation data to generate the compensated gray data.

3. The display device of claim 1, wherein the controller includes:

a first memory storing a plurality of gray compensation LUTs according to predetermined temperature intervals, respectively;

an arithmetic unit calculating the compensation proportion parameter based on two gray compensation LUTs corresponding to the temperature interval approximating the peripheral temperature;

an extraction unit extracting the compensation data from one of the gray compensation LUTs in the first memory based on the compensation proportion parameter;

a subtraction unit generating a temperature ratio data based on a difference between a temperature of the one of the gray compensation LUTs and the peripheral temperature;

a multiplier unit multiplying the temperature ratio data by the compensation proportion parameter to generate a temperature compensation value; and a summation unit adding the temperature compensation value and the compensation data to generate the compensated gray data.

4. The display device of claim 1, wherein the liquid crystal display unit comprises:

a liquid crystal panel comprising a plurality of gate lines, a plurality of data lines insulated from the gate lines and extending perpendicular to the gate lines, and a plurality of pixels arranged in a matrix shape, wherein each of the pixels includes a switching element that is coupled with each of the data lines and each of the gate lines;

a gate driver activating the switching element; and a data driver outputting the compensated gray data to the data line.

5. The display device of claim 1, wherein each of the first and second compensation data is extracted based on a gray data of a current frame and a gray data of a preceding frame.

6. The display device of claim 1, further comprising:

a temperature sensor sensing the peripheral temperature.

7. A display device, comprising:

a liquid crystal panel;

a data driver providing a data signal to the liquid crystal panel;

a memory storing a plurality of gray compensation LUTs respectively corresponding to a plurality of temperature intervals; and a timing controller reading compensation data from the memory based on gray data of a current frame and gray data of a preceding frame, wherein the timing controller comprises:

an extraction unit extracting compensation data from the gray compensation LUTs;

a subtraction unit generating difference data a multiplier unit multiplying the difference data by a compensation proportion parameter to generate a temperature compensation value; and a summation unit generating compensated gray data, wherein when a peripheral temperature of the display device is included in at least one of the temperature intervals, the extraction unit extracts first compensation data from a gray compensation LUT corresponding to a temperature interval including the peripheral temperature, and wherein when the peripheral temperature of the display device is not included in any of the temperature intervals, the extraction unit extracts a second compensation data from the gray compensation LUT corresponding to one of the temperature intervals having a temperature approximating the peripheral temperature, the subtraction unit generates the difference data relating to a difference between current gray data and the second compensation data, the multiplier unit multiplies the difference data by the compensation proportion parameter to generate the temperature compensation value, and the summation unit sums the temperature compensation value and the current gray data to generate the compensated gray data, wherein if Gn represents the current gray data and if Gc represents the second compensation data, the difference data generated from the subtraction unit is Gn−Gc.

8. A display device having a liquid crystal panel for displaying an image, comprising:

a data driver providing a data signal to the liquid crystal panel;

a memory storing a plurality of gray compensation LUTs respectively corresponding to a plurality of temperature intervals; and a timing controller reading out compensation data from the memory based on gray data of a current frame and gray data of a preceding frame, wherein the timing controller comprises:

an extraction unit extracting compensation data from the gray compensation LUTs;

a subtraction unit generating difference data;

a multiplier unit multiplying the difference data by a compensation proportion parameter to generate a temperature compensation value; and a summation unit generating compensated gray data, wherein when a peripheral temperature of the display device is included in at least one of the temperature intervals, the extraction unit extracts first compensation data from a gray compensation LUT corresponding to a temperature interval including the peripheral temperature as a compensated gray data, and wherein when the peripheral temperature of the display device is not included in any of the temperature intervals, the extraction unit extracts second compensation data from the gray compensation LUT corresponding to one of the temperature intervals having a temperature approximating the peripheral temperature, the subtraction unit generates the difference data relating to a difference between current gray data and the second compensation data, the multiplier unit multiplies the difference data by the compensation proportion parameter to generate the temperature compensation value, and the summation unit sums the temperature compensation value and the current gray data to generate the compensated gray data, wherein if Gn represents the current gray data and if Gc represents the second compensation data, the difference data generated from the subtraction unit is Gn−Gc.

9. The display device of claim 8, wherein the timing controller comprises:

a LUT generation unit calculating an a LUT for the compensation proportion parameter based on two gray compensation LUTs corresponding to the temperature interval approximating the peripheral temperature, and wherein the memory comprises, a first memory storing a plurality of the gray compensation LUTs according to temperature intervals, respectively; and a second memory storing the a LUT for the compensation proportion parameter.

* * * * *